United States Patent [19]

Kempton

[11] 4,216,720

[45] Aug. 12, 1980

[54] ROD-FRAGMENT CONTROLLED-MOTION WARHEAD (U)

[75] Inventor: Marvin L. Kempton, Socorro, N. Mex.

[73] Assignee: The United States of America as represented by the Secretary of the Navy, Washington, D.C.

[21] Appl. No.: 475,486

[22] Filed: May 30, 1974

[51] Int. Cl.[3] ..... F42B 13/48

[52] U.S. Cl. ..... 102/67; 102/64

[58] Field of Search ..... 102/64, 67

[56] References Cited

U.S. PATENT DOCUMENTS

| | | | |
|---|---|---|---|
| 3,490,374 | 1/1970 | Nooker | 102/67 |
| 3,491,694 | 1/1970 | Fountain | 102/67 |
| 3,498,224 | 3/1970 | Cordle et al. | 102/67 |
| 3,722,414 | 3/1973 | Talley | 102/67 |
| 3,768,414 | 10/1973 | Polcha | 102/67 |

*Primary Examiner*—Harold J. Tudor

*Attorney, Agent, or Firm*—Richard S. Sciascia; Thomas M. Phillips

[57] ABSTRACT

The destructive fragments used in the warhead are in a form of rods of substantially the same length as the warhead itself. Effectiveness is increased by so controlling the outward travel of the rods as to produce a propellering motion about the center of the rods capable of causing the rods to line-up end-to-end at a particular desired radius. The long rods are disposed longitudinally side-by-side in a circular path to form a continuous sleeve about a cylindrical explosive charge. Each rod also is inclined at a slight angle from the longitudinal axis of the warhead to induce the desired propellering motion. The velocity of the warhead is made uniform throughout the length of each rod to minimize tumbling.

7 Claims, 6 Drawing Figures

FIG. 1.
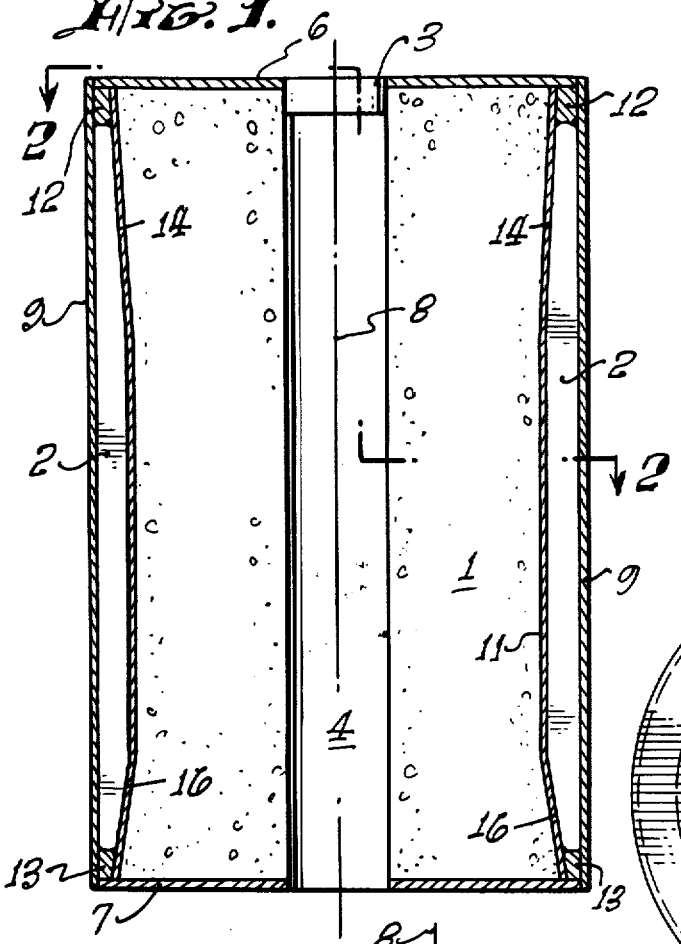
FIG. 2.
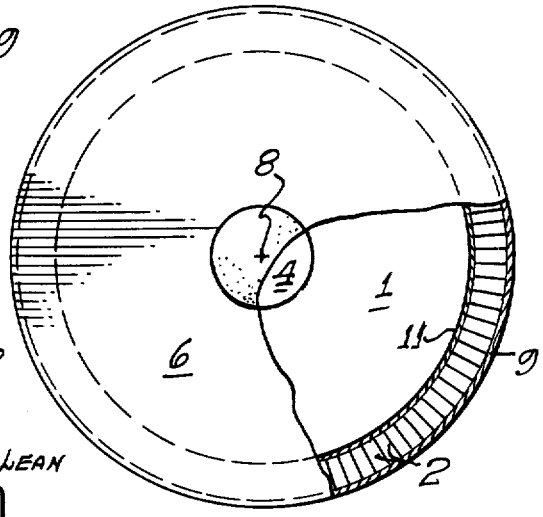
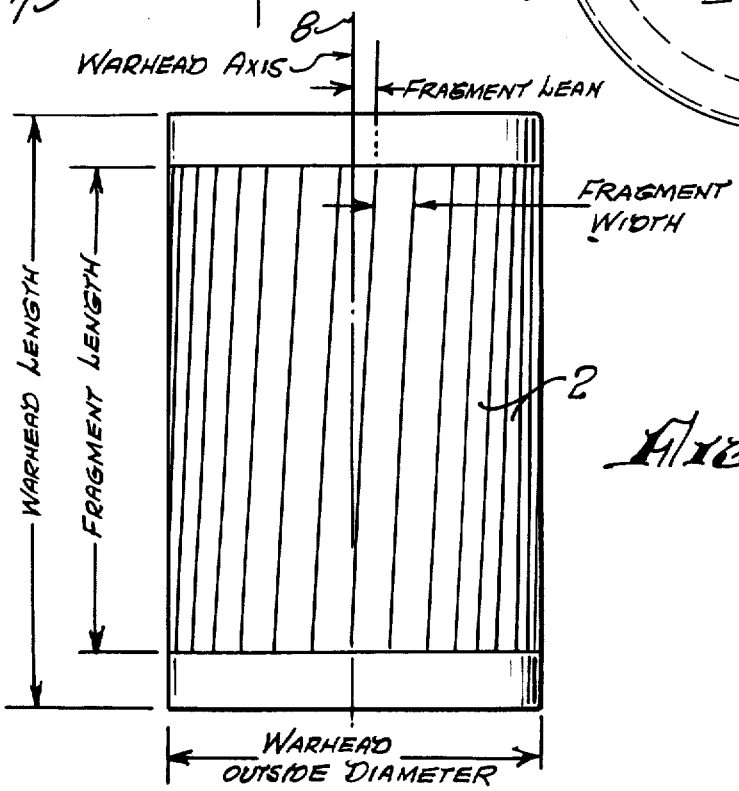
FIG. 3.

ROD-FRAGMENT CONTROLLED-MOTION WARHEAD (U)

BACKGROUND OF THE INVENTION

The present invention relates to explosive warheads of the rod-fragment type and, more particularly, to means for controlling the motion of the rods during their outward flight.

Several factors strongly influence the effectiveness or, in other words, the 'kill' capacity of fragmentation warheads such as are used, for example, against target aircrafts in surface-to-air missile systems. One such system employs a so-called 360° planar focused-fragment warhead which, when detonated, explosively drives high velocity fragments in all directions. The lethality of such warheads has been improved by focusing techniques and also by maximizing the striking energy-density.

It also has been recognized that, although such warheads are reasonably effective when the hit is in particular locations such as the location of the compressors or turbines of the aircraft, their lethality is not as effective when the hit occurs only in the structural portions. This relative ineffectiveness obviously is a matter of some concern and various efforts to improve this aspect of performance have been made. One such effort, for example, has been the use of long rod-type fragments rather than the more commonly used wires or other smaller fragments. In this regard, it has been recognized that a hit by a relative long fragment is capable of producing more disabling structural damage than normally would be caused by the smaller fragments. Such a rod arrangement is disclosed in U.S. Pat. No. 3,228,336 "Rod Warhead" issued Jan. 11, 1966 to Marvin L. Kempton. As there disclosed, the fragments of the warhead are provided by a plurality of rods connected or hinged together at their end portions in such a manner that the detonation of the explosive charge expands the rods at high velocity into a substantially continuous loop or ring for projection toward the target. Thus, the target or aircraft is struck by a substantially continuous string of elongate fragments capable of producing lethal structural damage. Although this 'loop'-type of rod arrangement is excellent against some targets, it is not adapted for use against the very high speed targets which presently are of primary concern.

The use of elongate, discrete as opposed to continuous rods has been considered and their advantages, of course, appreciated. However, experimentation has shown that the pattern of these rod-type fragments on the target has been of such a discontinuous nature as to result in a high likelihood of missing various structural members. For one reason, the use of the longer rods obviously limits or reduces the number of fragments in the warhead and, of equal significance, the outward flight of such rod-type fragments is of such an uncontrolled nature that the fragments strike the target and produce somewhat of a 'cannonball effect' resulting again in reduced warhead lethality due to the likelihood of missing the significant structural members. Another factor which limits their effectiveness is produced by what is known as a tendency for a polar drift, or, in other words, a tendency for the pattern to spread in an axial direction rather than be driven radially into the target.

BRIEF SUMMARY AND OBJECTS OF THE INVENTION

A principle object of the present invention is to provide a warhead utilizing elongate rods as fragments and providing an arrangement for controlling the outward motion of the fragments so as to significantly increase the kill-radius of the warhead.

Another object is to provide a warhead in which the polar drift of the fragment pattern is reduced to a minimum.

In general, the invention utilizes a plurality of discrete rods which, preferably, have a length of about equal to the length of the warhead itself. The rods are disposed side-by-side to form a sleeve-like row backed by an explosive charge. The arrangement is such that detonation explosively drives the rods outwardly in a flight disposition in which the longitudinal axis of each rod lies perpendicular to its own line-of-flight. However, rather than permit an uncontrolled outward motion during flight, the warhead mounts the rods in such a manner that each rod retains this perpendicularity and also achieves a slow propeller action or, in other words, a rotational movement about its longitudinal center. Control of this motion is achieved essentially in two manners. First, the charge of the explosive and the mass of the rods is so proportioned relative one to the other that there is a substantially uniform velocity to mass ratio throughout the entire length of each fragment. In other words, the driving force that produces the velocity of the rods is equalized throughout the length of the rods to assure perpendicularity during flight. Secondly, each of the rods is disposed at a certain inclination or 'lean' relative to the longitudinal axis of the warhead and the angle of inclination is the same for each rod in the row. The so-called 'lean' causes the rods to propeller in a uniform manner and, depending upon the degree of the lean as well as other factors, the outwardly-propellering rods eventually line-up end-to-end at a particular radius which will maximize the probability of kill. A further feature is the fact that the propellering rate itself can be controlled by the lean so that, depending on the type of target, the rods can be made to strike at any desired rotated disposition.

DETAILED DESCRIPTION OF THE DRAWINGS

The present invention is illustrated in the accompanying drawings of which:

FIG. 1 is a central longitudinal sectional view showing one form of the warhead used in the present invention;

FIG. 2 is a top end view of the warhead of FIG. 1;

FIG. 3 is a side elevation of the FIG. 1 warhead with its outer encasement removed to show the underlying fragment arrangement;

DETAILED DESCRIPTION OF THE INVENTION

Figure 4:
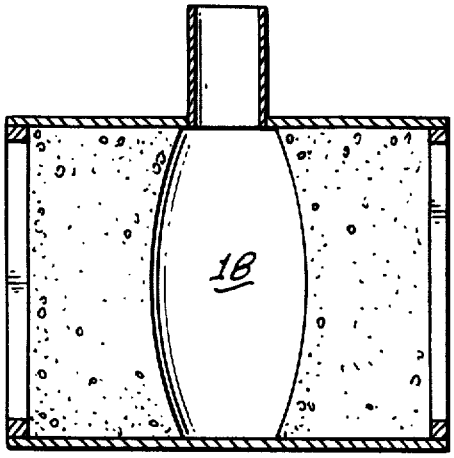
FIG. 4 is a view similar to FIG. 1 showing another form of the warhead utilizing a shaped charge.

With reference to FIGS. 1 and 2, the illustrated warhead is a so-called 360° planar, focused-fragment warhead having a cylindrical high explosive charge 1 disposed radially inwardly of and closely adjacent to warhead fragments 2 which, of course, are the destructive fragments driven by the explosive into the aircraft target. In operation, the warhead is flown into close proximity with the target where it senses the target presence by means of known fusing arrangements which, in turn, energize detonators such as single-end booster 3 and cause the warhead to explosively fire. It also perhaps should be noted at this point that the term 'warhead', as presently used, is intended to connote only the fragment-carrying portion of the missile although this term sometimes is used to include the entire missile component.

Explosive charge 1, as well as booster 3 can be of any conventional form subject to the particular functional limitations which will be described. As shown, charge 1 is formed by a body of high explosive material having a central void or bore 4 and, in manners known to the art, the explosive may be liquid cast into place or otherwise formed into the configuration illustrated both in FIG. 1 and FIG. 4. Upper and lower end plates 6 and 7 maintain the structure.

Fragments 2 are elongate, large rods disposed in a side-by-side arrangement and, as may be noted in FIG. 1, these rods have a length substantially equal to the length of the warhead itself. By way of illustration, one such warhead that has been successfully tested is 15¾" long with rods of about 14". By way of example, the rods are rectangular in shape with cross sectional dimensions of ⅜"×5/32". The rod material, as well as other materials used in the warhead again may be conventional and in accordance with their intended use.

The warhead, further, has outer and inner side walls or encasement members 9 and 11 between which the bundle or circular, sleeve-like row of rods are closely fitted. Outer casing 9 provides requisite strength and aerodynamic characteristics for the warhead. For example, it may be formed of a steel sheet having a thickness of about 1/16". Interior wall or casing member 11 can be formed of a similar sheet having about half the thickness of outer casing 9. End rings 12 and 13 are optional. When used, they are disposed at each end of the warhead between the end walls and the rods and are tack-welded to the ends of the rods to further maintain the particular rod arrangement which will be described.

It already has been noted that the use of elongate rod-type fragments such as fragments 2 is capable of materially increasing the lethality of the aircraft hits particularly when the hits occur on structural portions of the target. Such elongate rods increase the kill-radius of the warhead. However, as compared with smaller cube-like or bar-type fragments, it is equally apparent that the presently-illustrated warhead has room for far fewer of the larger fragment units so that the effectiveness of each unit or fragment must be maximized if the effectiveness of the warhead as a whole is to be improved. If the fewer, elongate, rod-type fragments are permitted to freely gyrate or tumble during their flight to the target, the result is that the large fragments strike the target with a 'cannonball' effect to produce such a discontinuous pattern as to possibly miss the more vital structural members. Also, random uncontrolled motion produces a pattern which tends to spread undesirably in an axial direction. In other words, it tends toward a polar drift.

The present invention overcomes such difficulties by controlling the motion of the fragments during their outward flight. In particular, flight motion of the fragments is controlled by two factors. First, the arrangement assures that the velocity to mass ratio is uniform throughout the entire length of each rod so that all portions of each rod are subjected to the same outward velocity in their outward flight. Thus, they maintain a perpendicularity relative to their line of direction. This particular factor can be accomplished in the manner illustrated in FIG. 1 by forming each of the rods with tapering end portions 14 and 16. The degree and extent of the taper can be calculated or empirically derived for the particular explosive charge being employed. In particular, the taper must take into account the fact that the velocity to mass ratio must be increased at the end portions of the rods to compensate for the higher degree of charge force exerted toward the central portion of the rods. The principle effort in this regard is one of reducing the velocity at the center-of-length of the rods to a value substantially equal to the velocity at each end of the rods considering the fact that the velocity at the end of the rods should be as large as possible for maximum effectiveness. It is apparent that other rod configurations might be employed providing the arrangement assures the uniform velocity ratio throughout the rod length. For example, as shown in FIG. 4, the rods can be untapered and the charge itself shaped or provided with a convex, bulb-like hollow center area 18. The shaping then produces the uniform velocity ratio along the length of the rods. Similarly, the rods and charge both can be shaped.

Figure 5:
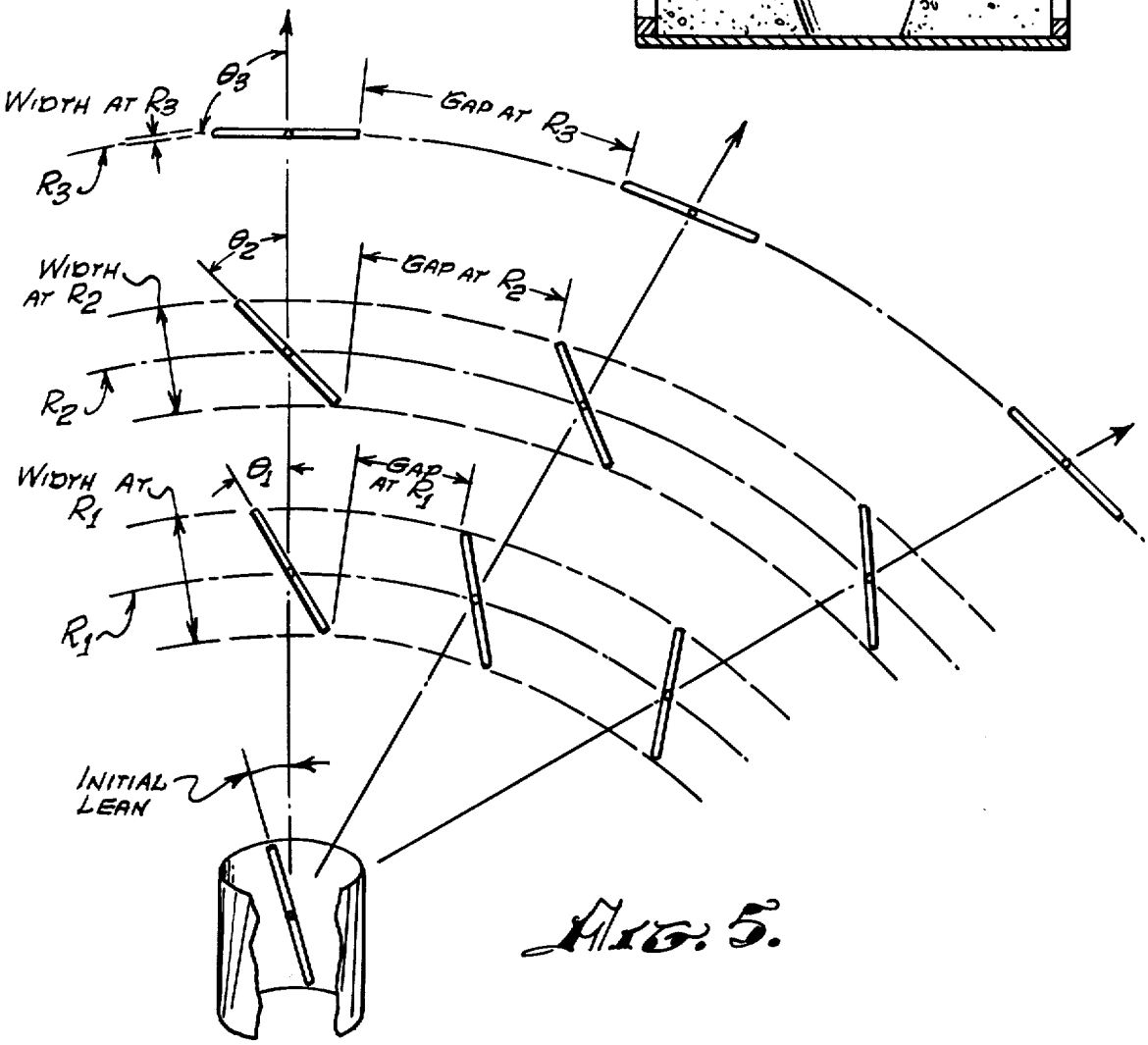
FIG. 5 is a diagram illustrating the fragment propellering-motion.

The second factor required for the requisite motion control is one of assuring the propellering action illustrated in the operational diagram of FIG. 5. As shown in FIG. 5, each rod, as it is propelled radially outwardly, must rotate or propeller about its central axis so as to arrive at the end-to-end disposition (FIG. 5) at a particular radius designated $r_3$ which is the designed radius of the warhead. At this radius, the end-to-end arrangement assures a minimum gap between the ends of the rods and this minimum gap coupled with the rod lengths themselves assure maximum probability of kill. To achieve this purpose, rods 2 are arranged in the inclined disposition thus seen in FIG. 3. More particularly, each of the rods 2 is inclined at a particular angle to the longitudinal axis of the warhead designated by line 8, FIG. 3, and the inclination or fragment lean of each rod is the same as all the others. Preferably, this lean or angle of inclination designated 0° in FIG. 5, is relatively small and, again, the precise amount of the lean is a matter for individual determination since the lean of the rods itself will play a large part in fixing the designed radius of the warhead. In this regard, it will be recognized that some targets may require some other rotational disposition of the rods. For example, a heavily-armored target might better be attacked using a piercing action. Further, targets may lie at varying radii from the warhead at the time of detonation. To accommodate these varying conditions, the rotational ratio of propellering can be controlled to produce the end-to-end disposition, or any other disposition, at any anticipated radius. Control is largely achieved by the degree of the lean although, as will be appreciated, the precise degree has to be ascertained empirically for each configuration.

Another quite significant factor resulting from the motion control is that the rods in their outward flight are so constrained in their motions as to exhibit little tendency toward the polar drift which has been described. This salutary effect also improves the destructive potential of the fragment pattern by retaining its concentration or density.

Figure 6:
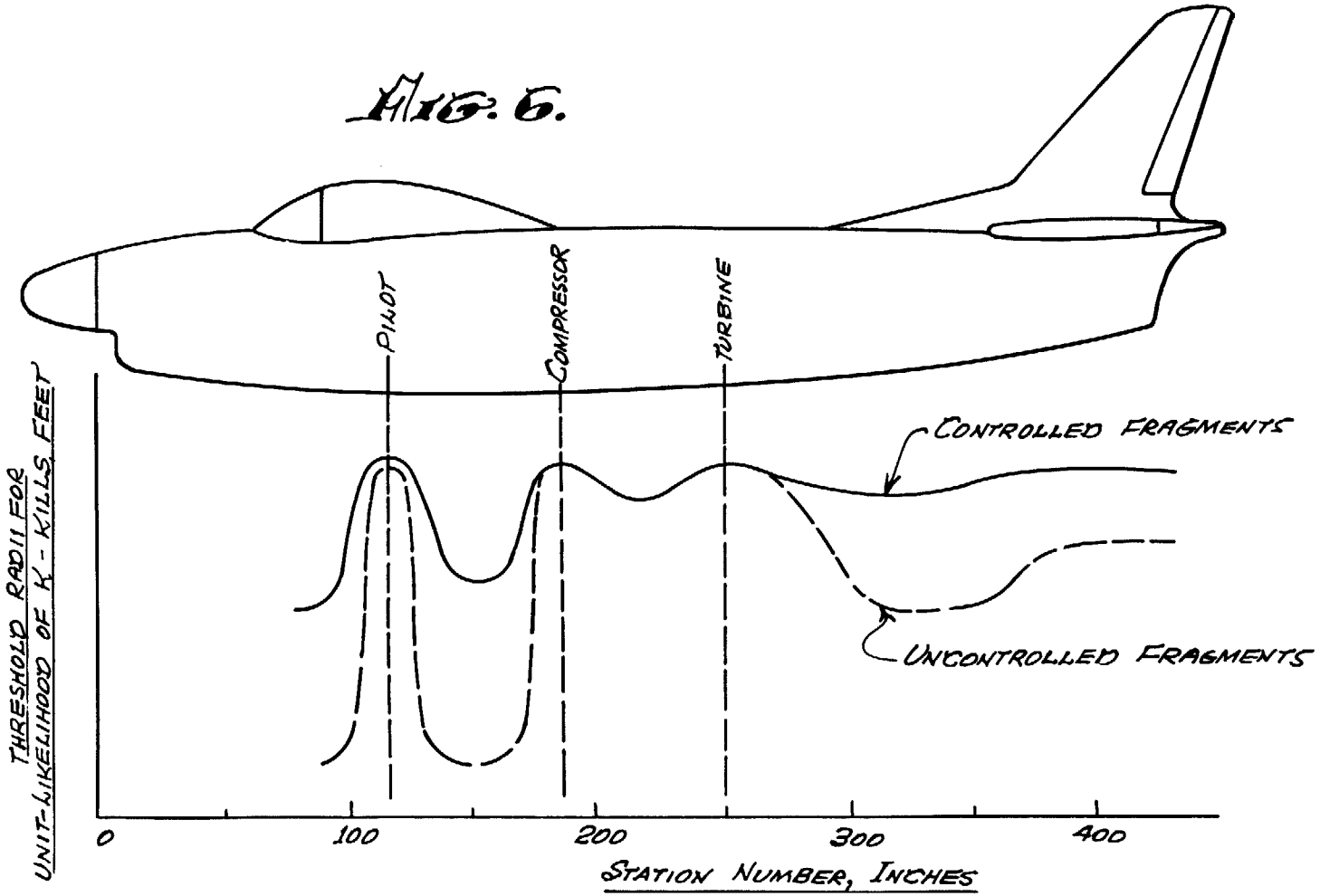

FIG. 6 is provided to illustrate the improvements in the kill-radius cut-off permitted by the use of motion control fragments as contrasted with the fragments in which the outward motion is uncontrolled. In this particular illustration, the threshhold radii for unit-likelihood k-kills (kill-radius cut-off) shown for each region is associated with the most vulnerable k-kill contributor located within that region. The particular contributors will be recognized by those familiar with this art. As will be seen, the use of the controlled-motion fragments greatly improves the kill radius when the hit lies within the structural portions of the aircraft as opposed to the pilot, compressor and turbine portions.

In general, it will be recognized that the present warhead not only substantially improves the structural lethality of rod-type warheads but, in addition, the arrangement which provides these improvements is relatively simple, inexpensive and easy to fabricate.

Obviously many modifications and variations of the present invention are possible in the light of the above teachings. It is therefore to be understood that within the scope of the appended claims the invention may be practiced otherwise than as specifically described.

I claim:

1. A rod-fragment controlled-motion warhead comprising:

a series of discrete elongate rod-like fragments disposed laterally-adjacent one to the other for forming a side-by-side row, an explosive charge disposed interiorally of and closely adjacent to said row substantially co-extensive with said elongate fragments, structural means maintaining said row and charge in said adjacent relationship, and means for detonating said charge for forcefully driving said fragments at a high velocity outwardly from the longitudinal axis of said warhead, said fragments of said row each being disposed at a substantially identical inclination from said warhead axis whereby said fragments propeller equally in the same rotational direction during their outward travel eventually to line-up end-to-end at a particular radius;

said explosive charge and the mass of said fragments being relatively arranged to provide a substantially uniform velocity ratio throughout the entire length of each fragment whereby tumbling action is minimized.

2. The warhead of claim 1 wherein said row of fragments is circular and said explosive charge is generally cylindrical and co-extensive with said longitudinal extent of said fragments.

3. The warhead of claim 2 said rod-like fragments are tapered for providing said desired velocity ratio.

4. The warhead of claim 2 wherein said explosive charge is shaped for providing said desired velocity ratio.

5. The warhead of claim 2 wherein said circular row of fragments is provided by a single-layer series of said fragments.

6. The warhead of claim 5 wherein said detonating means is an end-mounted booster means.

7. The warhead of claim 5 wherein said rod-like fragments have a length to diameter ratio of about 28::1.

* * * * *